US005765624A

United States Patent [19]

Hathaway et al.

[11] Patent Number: 5,765,624

[45] Date of Patent: Jun. 16, 1998

[54] PROCESS FOR CASTING A LIGHT-WEIGHT IRON-BASED MATERIAL

[75] Inventors: Robert M. Hathaway, Oshkosh; Pradeep K. Rohatgi, Milwaukee, both of Wis.

[73] Assignee: Oshkosh Truck Corporation, Oshkosh, Wis.

[21] Appl. No.: 546,903

[22] Filed: Oct. 23, 1995

Related U.S. Application Data

[63] Continuation of Ser. No. 223,956, Apr. 7, 1994, abandoned.

[51] Int. Cl.[6] ..... B22D 19/14

[52] U.S. Cl. ..... 164/97; 164/98

[58] Field of Search ..... 164/97, 75, 91, 164/98, 100

[56] References Cited

U.S. PATENT DOCUMENTS

| | | | |
|---|---|---|---|
| 1,893,540 | 1/1933 | Edmondson et al. | 164/75 |
| 1,926,770 | 9/1933 | Harris et al. | 164/91 |
| 1,981,403 | 11/1934 | Weitzenkorn | 164/97 X |
| 3,175,260 | 3/1965 | Bridwell et al. | 164/97 |
| 3,728,108 | 4/1973 | Sifferlen et al. | 420/8 |
| 3,864,124 | 2/1975 | Breton et al. | 75/212 |
| 3,914,507 | 10/1975 | Fustukian . | |
| 4,024,902 | 5/1977 | Baum | 164/97 |
| 4,194,040 | 3/1980 | Breton et al. | 428/308 |
| 4,327,156 | 4/1982 | Dillon et al. | 428/614 |
| 4,420,441 | 12/1983 | Singer | 264/7 |
| 4,490,172 | 12/1984 | Moore et al. | 75/58 |
| 4,565,571 | 1/1986 | Abbaschian | 75/0.5 C |
| 4,589,176 | 5/1986 | Rosman et al. | 416/241 R |
| 4,608,318 | 8/1986 | Markrides et al. | 428/614 |
| 4,664,982 | 5/1987 | Genovese et al. | 428/447 |
| 4,726,415 | 2/1988 | Ueno et al. | 164/253 |
| 4,780,274 | 10/1988 | Barr | 164/97 X |
| 4,853,182 | 8/1989 | Cornie et al. | 420/129 |
| 4,871,008 | 10/1989 | Dwivedi et al. | 164/6 |
| 4,932,099 | 6/1990 | Corwin | 164/97 |
| 5,005,631 | 4/1991 | Dwivedi | 164/97 |
| 5,007,475 | 4/1991 | Kennedy et al. | 164/97 |
| 5,010,945 | 4/1991 | Burke | 164/97 |
| 5,040,588 | 8/1991 | Newkirk et al. | 164/97 |
| 5,049,443 | 9/1991 | Kuszaj et al. | 428/332 |
| 5,066,546 | 11/1991 | Materkowski | 428/627 |
| 5,104,458 | 4/1992 | Sundstedt et al. | 148/321 |
| 5,119,864 | 6/1992 | Lanensiepen et al. | 164/97 |
| 5,141,819 | 8/1992 | Aghajanian et al. | 428/545 |
| 5,141,821 | 8/1992 | Lugscheider et al. | 428/614 |
| 5,154,425 | 10/1992 | Niskanen et al. | 273/167 |
| 5,165,463 | 11/1992 | Aghajanian et al. | 164/97 |
| 5,172,747 | 12/1992 | Aghajanian et al. | 164/97 |
| 5,247,986 | 9/1993 | Kantner et al. | 164/97 |
| 5,337,801 | 8/1994 | Materkowski | 164/98 |
| 5,381,850 | 1/1995 | Otte et al. | 164/97 X |
| 5,511,603 | 4/1996 | Brown et al. | 164/97 |

FOREIGN PATENT DOCUMENTS

| | | | |
|---|---|---|---|
| 0273852 | 7/1988 | European Pat. Off. | 428/614 |
| 1949777 | 10/1970 | Germany | 164/97 |
| 272429 | 10/1989 | Germany | 164/97 |
| 57-160564 | 10/1982 | Japan | 164/97 |
| 3236453 | 4/1983 | Japan | 420/8 |
| 59-199165 | 11/1984 | Japan | 164/97 |
| 61-27165 | 2/1986 | Japan | 164/97 |

OTHER PUBLICATIONS

Merriman, "A dictionary of Metallurgy", TN609 M47. C8, 1958, pp. 139–140.

Weast, "Handbook of Chemistry and Physics", 54th Edition, QD 65. Apr. 1973, pp. B–64,74,83,94,97,111,114,133,144, 149–150,152,155.

Perry et al., Chemical Engineers 'Handbook , Fifth Edition, 1973, PP. 21–41.

*Primary Examiner*—J. Reed Batten, Jr.

*Attorney, Agent, or Firm*—Philip G. Meyers

[57] ABSTRACT

A iron-based material such as cast iron is made by a process wherein filler particles are added to an iron base metal, as the base metal is poured into the mold. Pieces containing ceramic filler particles held together by a binder can be disposed in the mold prior to pouring molten iron base metal therein. Molten iron base metal is then poured into the mold so that the molten base metal contacts the pieces, gradually dissolving the filler. The filler becomes distributed throughout the molten base metal within the mold. Upon cooling, the base metal has the filler distributed therein, resulting in a iron-based material. The resulting material is particularly useful for making vehicle parts normally made of cast iron or steel.

18 Claims, 2 Drawing Sheets

PROCESS FOR CASTING A LIGHT-WEIGHT IRON-BASED MATERIAL

This application is a division of application Ser. No. 08/223,956, filed Apr. 7, 1994, abandoned.

TECHNICAL FIELD

This invention relates to the preparation of light-weight cast iron.

BACKGROUND OF THE INVENTION

There is a need for reduced weight, high strength materials for production of products such as automobiles, trucks, aircraft, furniture, structural materials and the like. Such materials can provide vehicles with greater fuel efficiency, transportability, and/or greater payload capacity due to reduced vehicle weight. Metal-ceramic mixtures have been proposed as one such material. These metal-ceramic mixtures are formed by introducing ceramic materials into matrices of base metals. However, the techniques which are currently available for forming such mixtures are either too cumbersome, unsuitable for use with iron base metals, or unable to be easily and inexpensively incorporated into current foundry techniques.

Various methods have been developed for preparing metal ceramic mixtures. In one conventional process, the mixture is formed by a powder metallurgy technique. A fine powder of base metal, such as iron, is mixed with another material, usually a ceramic particulate such as tungsten carbide, and then pressed into a compact. The compact is then sintered at a high temperature. This allows interdiffusion between metal-metal and metal-ceramic particles and thereby forms a mixture in which the ceramic is dispersed throughout a base metal matrix.

A number of problems limit the use of powder metallurgy techniques in the formation of hard, high strength composites. This method requires considerable effort to ensure complete mixing of the ceramic and iron base metal powders in order to ensure adequate uniform dispersion of the ceramic throughout the base metal. Further, the sintering process itself must be carefully monitored to avoid thermal and mechanical stresses that can otherwise result in structural weakness. Sintered parts must often be trimmed or machined into final shape, but the nature of high melting temperature metal composites can make this difficult. The hardness of such mixtures can quickly blunt or chip most cutting tool edges. In addition, there is a high cost associated with this technique; powder metallurgy requires dies with high tooling costs.

Cornie et al. U.S. Pat. No. 4,853,182 teaches the formation of carbide ceramics dispersed in a base metal. This technique calls for the addition of a refractory metal to a molten metal which contains carbon. The refractory metal reacts with the carbon in the molten solution to form ceramic precipitates, which, upon cooling, are uniformly distributed throughout the iron matrix. This method is useful but is limited to ceramics which can be produced by precipitation from the molten base metal. The base metal must contain enough carbon to react with the refractory metal and produce the ceramic particulates.

Compocasting is one of the simplest and most efficient methods of forming composites. Compocasting entails mixing ceramic or other powders directly into a molten or semi-solid base metal. This technique has been of limited usefulness due to several problems. Most of the metal matrix composites formed by compocasting have used low melting temperature metals such as aluminum as the base metal. However, these low melting base metal composites are unsuitable for applications requiring strength and durability, for example, for off-road and tactical military vehicle parts.

Difficulties have been encountered in attempts to utilize compocasting methods in conjunction with high melting temperature base metals such as iron and steel. Wettability is a problem for ceramic fillers. Direct stirring of the filler in the high melting temperature metal is difficult due to density differences between the base metal and filler material, which may cause the ceramic to float to the surface during stirring. In particular, current aluminum matrix metal composite techniques require agitation of the pouring ladle with a steel impeller to distribute the reinforcement throughout the melt prior to pouring it into the mold. The high temperature of molten iron precludes this method of filler addition.

A need persists for a simple, inexpensive process for forming lightweight, cast iron, particularly using a variety of ceramic fillers.

SUMMARY OF THE INVENTION

A material of the invention comprises a matrix of iron based metal. The iron based metal matrix has particles of a ceramic distributed therein, and may further have a metallic binder dissolved therein. The binder has a melting point the same or less than that of the base metal, and is used to bind together the preformed ceramic particles during casting of the cast iron, as described further below.

A process for casting a light-weight cast iron according to the invention comprises the steps of forming a melt of iron based metal, placing one or more pieces comprising ceramic particles held together by a binder into position for contact with the molten stream of base metal during pouring into the mold, pouring the molten base metal into the mold so that the molten base metal contacts the pieces containing the ceramic particulate, whereby ceramic particulates are gradually released into the stream of molten base metal as it flows into the mold and become distributed in the molten base metal, and cooling the base metal to form a composite having the ceramic particles distributed therein. The pieces containing the ceramic particulates may be disposed in spaced positions in the mold prior to pouring molten base metal therein, and may also be disposed at the bottom of the mold downsprue, runner, riser base, riser neck, or the equivalent, e.g., an area in the mold that feeds the molten metal to the casting mold. Pieces disposed in the mold are preferably secured to the mold wall prior to pouring molten base metal therein.

According to one embodiment of the process of the invention, the pieces containing the ceramic particulates are disposed in the mold which permits the molten stream to release filler particles and flow therethrough. In another embodiment, cooling is delayed so that filler particles having a different density than the base metal rise or sink towards an outer surface of the casting. The casting thereby has more of the filler particles in a surface portion than in its interior. These and other aspects of the invention are described in the detailed description which follows.

BRIEF DESCRIPTION OF THE DRAWING

The invention will be described with reference to the accompanying drawing, wherein like numerals describe like elements, and.

DETAILED DESCRIPTION OF PREFERRED EMBODIMENTS

Figure 1:
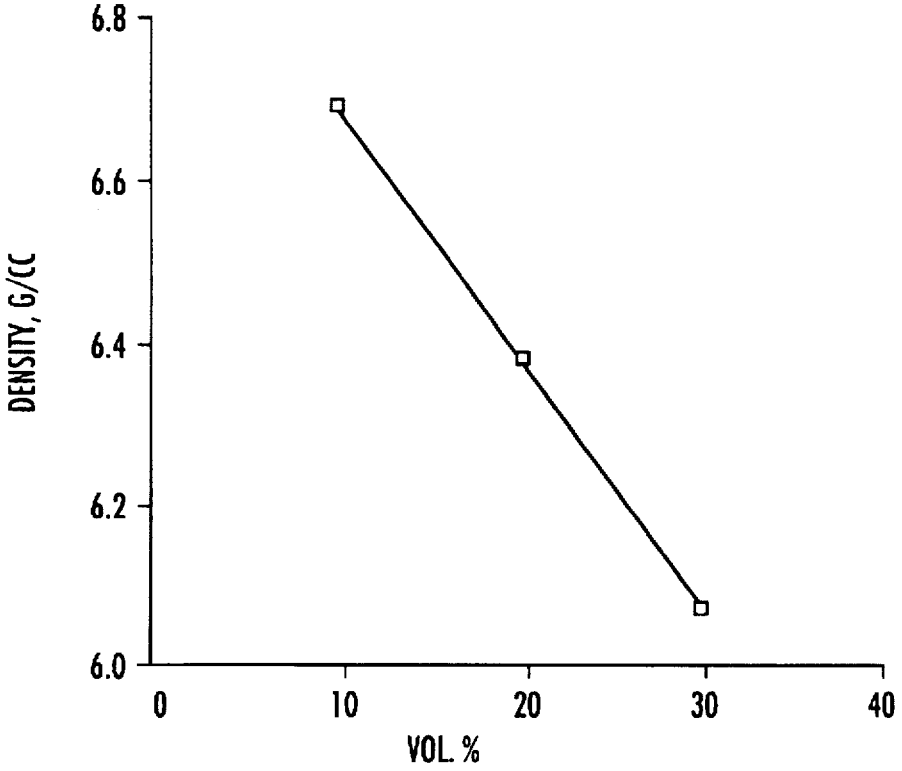
FIG. 1 is a graph of theoretically calculated density (D) in g/cm$^3$ versus volume percent (V) of ceramic alumina in cast iron.

The light-weight cast iron of the present invention is comprised of ceramic particles distributed in an iron based metal. The particulate is a ceramic, particularly an inorganic oxide, carbide, nitride, or a mixture thereof. The ceramic particles preferably have a melting point higher than that of the cast metal, i.e., should not react or dissolve in the metal matrix, and have a modulus of elasticity of at least about $20\times10^6$ psi. For applications such as vehicle parts, the ceramic particles are lighter than the surrounding iron base matrix so that the overall weight of the part is reduced. For this purpose, it is desirable to have the filler particles suitably distributed through the cast part in order to avoid weak spots and irregularities.

For other applications, such as a plow attachment for a vehicle, it may be more desirable to provide a cast part with a surface ceramic layer that provides an abrasion-resistant surface. In such a case it is desirable to have the ceramic particles migrate to the top or bottom of the casting, depending on density, rather than remain distributed throughout the interior of the casting. Cooling of the casting may be prolonged in order to allow the ceramic particles time to rise or sink.

Suitable particles include ceramic oxides, nitrides and carbides, particularly aluminum oxide, magnesium oxide, zirconium oxide, titanium oxide, tungsten oxide, titanium nitride, vanadium nitride, zirconium nitride, vanadium carbide, titanium carbide, silicon carbide, tungsten carbide, and mixtures thereof. The densities of such ceramics vary substantially. MgO, $Al_2O_3$, and SiC are particularly light (densities around 3–4 g/cm$^3$), $TiO_2$, TiN and TiC are of intermediate weight (densities around 4–5 g/cm$^3$) and the zirconium compounds are heavier (densities around 6–7 g/cm$^3$), but all are lighter than iron (density around 8 g/cm$^3$). Tungsten compounds such as WC or $W_2C$ (densities around 16–17 g/cm$^3$) and $WO_2$ (density around 12 g/cm$^3$) may be selected if a ceramic having a higher density than the surrounding metal is needed. Many of these compounds have high hardness and can be used to provide an abrasion-resistant surface layer.

The amount of filler, excluding the binder, may range from 10 to 40 volume percent of the casting, depending on the intended use of the casting involved, and preferably 30 to 40 volume percent for those castings requiring weight reductions on the order of 20%. The influence alumina has on the theoretical density and Young's modulus of cast iron can be as high as defined by the rule of mixtures as follows:

$$P_c=P_m*V_m+P_f*V_f$$

in which, $V_m$ is volume fraction of matrix in composite, $V_f$ is the volume fraction of ceramic particulate in the composite, $P_c$ is the density of the composite, $P_m$ is the density of the matrix material, and $P_f$ is density of ceramic reinforcement material. Based on the rule of mixtures, the cast iron of the present invention is different from known porous cast iron in that the $P_f$ and $E_f$ of the voids in porous cast iron is zero, resulting in no theoretical gain in the modulus of the material over the matrix.

The dependency of density on the volume fraction of ceramic particulate is shown in FIG. 1 for the castings prepared in the example below. Cast iron vehicle parts, such as a gear box housing, should have an elastic modulus of at least about $24.5\times10^6$ psi. The density data shows that using the filler in an amount of from about 30 to 40 volume percent leads to a significant decrease in the weight of the cast part.

The size of the ceramic particles is from 5μm to 100μm, most preferably from 9μm to 15μm. Excessively large particles will make the structure of the resulting casting too uneven, whereas extremely small particles tend to agglomerate.

As noted above, low density ceramic particles tend to float to the top of the composite. Using a mixture of ceramic particles of varying densities can help reduce this tendency. A mixture of large and small particles can also be used; smaller particles will not float as rapidly as larger particles. The light-weight cast iron casting may also be cooled quickly in order to reduce the time in which the ceramic particles may migrate through the molten base metal.

A binder is used to hold the ceramic particles together and in position within the mold for dispersion into the molten cast iron, particularly to ensure that ceramic particles flow into the casting at a relatively even rate. The binder is a metal which can dissolve in the iron base metal and which has the same or lower melting point than the iron base metal. Aluminum is most preferred for use when the base metal is iron or an iron alloy. Aluminum is an ideal matrix material for cast iron because cast iron has a relatively high solubility for aluminum, and aluminum in limited amounts does not adversely affect cast iron's mechanical or physical characteristics. In addition, aluminum's density is lower than the iron based metal, thus further reducing the weight of the casting. The 1220° F. melting point of aluminum allows it to dissolve when in contact with 2700° F. as poured, cast iron, transporting the ceramic particulate with the molten stream.

The amount of binder is preferably limited to an amount beneath the solubility limit of the binder in the base metal, so that the properties of the casting are not affected by discontinuous binder phases. The binder/ceramic mixture is preferably in a pellet or granular form, as opposed to a fine powder, to provide for gradual melting of the binder and release of the ceramic particles. The relative amounts of binder and ceramic in the mixture are not critical, but the mixture preferably contains only as much binder as is needed to hold the mixture together.

The molten base metal is a high-melting iron base metal such as cast iron, carbon steels, stainless steels, and iron alloys. "High-melting" for purposes of the invention refers to a melting point of about 1150° C. or higher. The base metal may be inoculated, if desired, with conventional inoculants. Such inoculation may take place prior to pouring the iron base metal in the mold, or within the mold itself. For cast iron, magnesium ferrosilicon is a preferred inoculant.

According to the process of the invention, the molten iron base metal is poured into the mold, where it comes into contact with the binder-ceramic particulate mixture. The molten base metal gradually melts the binder material, allowing the ceramic particles and melted binder to disperse uniformly throughout the molten metal. In a preferred embodiment, at least a portion of the ceramic is added to the base metal by placing some of the binder/ceramic mixture outside of the mold, preferably at the bottom of the downsprue. Alternately, the binder/ceramic particulate mixture can be placed in an intermediate pouring device, such as a funnel, which receives molten iron base metal from the ladle and gravity-feeds it into the downsprue.

A portion of the mixture containing ceramic particulate and binder material may be placed within the mold cavities and/or mold runner to provide more even distribution throughout the structure, or alternately, mixture pieces can be positioned to purposely concentrate the ceramic particulate in predetermined portions of the casting. The ceramic/binder pellets or pieces are preferably held in place within the mold cavities or the runner in order to allow even dispersion of the ceramic throughout the molten base metal. The ceramic/binder pieces are preferably secured to the wall of the mold by bonding prior to pouring of the molten iron based metal, or by providing separate mold indentations by which the pieces are mechanically restrained from being carried away in the flow of molten metal.

As the molten base metal is poured into the downsprue and spreads throughout the mold, the binder steadily dissolves, providing a substantially even, gradual release of the ceramic particles. The molten metal is then cooled and the resulting casting removed from the mold for surface finishing.

The present invention provides a number of advantages. Since iron is far less expensive than aluminum, the manufacturing cost of the iron base metal matrix composite is low in comparison to a low-melting aluminum alloy of comparable utility. An iron-based composite which utilizes an inexpensive base metal such as iron would be approximately three times less expensive to produce than a comparable aluminum metal matrix composite. Further, the strength and modulus of an iron-based composite is two to three times that of aluminum metal matrix composites.

The method for producing the light-weight cast iron of the invention can be easily integrated into current foundry practices and techniques. Little or no special equipment is needed, and contamination of the pouring ladle with extra ingredients is avoided. This enables the foundry to pour both reinforced and nonreinforced castings from the same heat. The process of the invention also improves the yield of a given heat of cast iron.

The reinforced casting of the invention, particularly when the amount of the ceramic is limited as described above, can have substantially the same properties as the base metal, but reduced weight. When the invention is used to make structural members or components for a vehicle, especially a truck, the weight reduction improves the fuel efficiency, transportability, and payload capacity of the vehicle.

EXAMPLE

Figure 2:
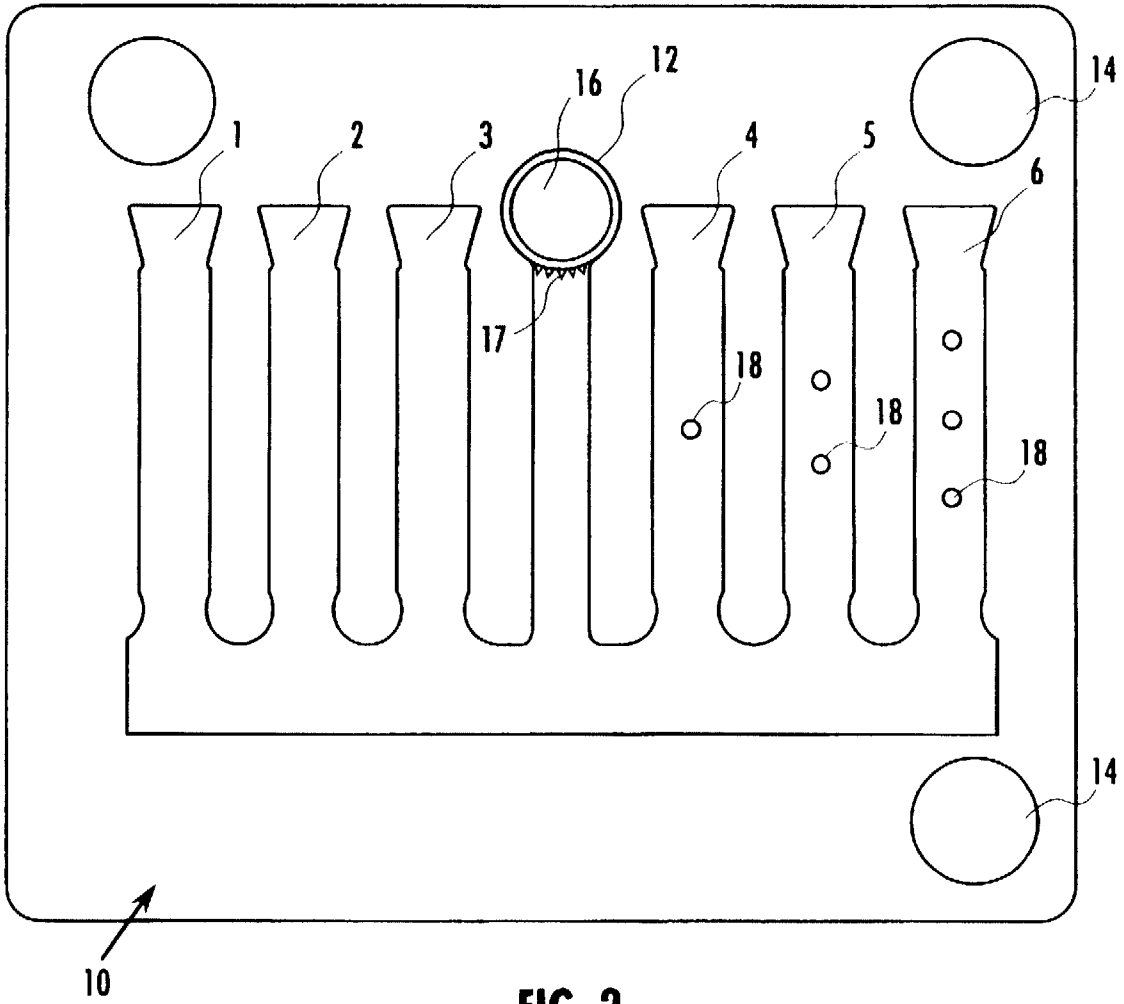
FIG. 2 is a top view of one half of a casting mold used in an example of the process of the invention.

A 1×6 tensile bar mold produced from a pattern in chemically bonded sand consisted of two halves. Referring to FIG. 2, one half of the mold (10) has a mold sprue (12) through which the molten base metal is introduced into the mold. Mold (10) had six cavities (1–6), three on either side of mold sprue (12), and projections (14) for coupling with the other half of the mold.

Additives (16) comprising 81.526 gm of COMALCO aluminum/alumina composite material together with a 63.84 g Foseco in-mold inoculation INOTAB made of magnesium ferrosilicon were placed at the bottom of mold downsprue (12). The COMALCO material is a commercially available, discontinuously reinforced composite comprising 20% by volume 9–15μm diameter, spherical $Al_2O_3$ and 80% by volume aluminum, and is sold for making aluminum extrusions and castings. Production components according to the invention would be produced with inserts that are predominantly ceramic particulate, as discussed above.

INOTAB mold inoculant tablets are known for use in providing consistent inoculation for improved casting quality and machinability. Through the INOTAB tablet was drilled a central hole, two cylindrical COMALCO pellets were fitted inside the hole so that they would be held therein during molding. Additional pieces of the Comalco material were placed around the outside of the Foseco tab and held in place with a surrounding basket (17) of bare steel wire. The cast iron used in this example was inoculated in the pouring ladle, and therefore the Foseco tab simply acted as a holder for part of the aluminum/alumina composite and provided an added boost of inoculant in the mold to improve the size, shape and distribution of the graphite nodules.

Mold cavities (1–3) received $Al_2O_3$ reinforcement only from the aluminum/alumina composite wired around the INOTAB at the bottom of the downsprue (12). One, two and three holes, ½" deep, ½" diameter, were respectively drilled into the mold wall of cavities 4, 5, and 6. Into these holes were placed ½" diameter by 1" long bars (18) of the same 20% by volume, discontinuously reinforced, spherical $Al_2O_3$/ aluminum COMALCO composite material. The composite material placed in the mold at cavities 4, 5, and 6 weighed respectively 9.578 gm, 18.315 gm, and 27.060 gm. The composite was placed in these locations to evaluate localized introduction of $Al_2O_3$ to the casting. The amount of composite material used was designed to expose as much ceramic reinforcement to the molten stream as possible, to enable ease of detection in metallographic samples.

The mold was then closed and readied for pouring. The cast iron was prepared using scrap AISI 1006 steel (0.06 wt. % C, balance essentially Fe) in an induction furnace. The base material was transferred to a pouring ladle in which the iron was inoculated with granular magnesium ferrosilicon consisting of approximately 70% silicon, 5% magnesium, 0.5% cerium, with the balance iron. Additional granular graphite was added to increase the carbon content from the 0.06% of the base metal to the 3.2% minimum total carbon required by SAE J434 for Grade D4512 ductile iron. The cast iron was then poured from a pouring ladle into the mold at an approximate temperature of 2600° F.

The casting was allowed to cool, and a metallographic examination of tensile bars 1–3 revealed successful transport of the spherical $Al_2O_3$ into the casting from the sprue bottom. As expected, higher filled levels were present in tensile bars 4–6 adjacent to the composite pieces inserted to the mold wall. Of particular interest was the low visible volume percentage of aluminum oxide particles present in the runner from the sprue bottom. Dissolution of the composite material around the Foseco tab was essentially complete. Hence, the successful transport of a ceramic particulate in a cast iron or other similar metal matrix can be accomplished in-mold both locally and throughout the casting.

The volume fraction of spherical $Al_2O_3$ in each bar was greater at the top surface of the bar than at the bottom, indicating that the ceramic reinforcement experienced flotation in the casting due to density differences prior to complete solidification of the ductile iron matrix. Examination of the microstructures revealed graphite nodule nucleation around the $Al_2O_3$ spherical particulate. The tensile bar of cavity 6, in which the greatest concentration of $Al/Al_2O_3$ composite material was inserted into the mold, revealed regions in which the aluminum had not gone into solution with the iron matrix.

It will be understood that the foregoing description is of preferred exemplary embodiments of the invention, and that the invention is not limited to the specific forms shown. For example, high melting base metals other than iron-based metals could be employed. This and other modifications can be made without departing from the scope of the invention as expressed in the claims.

We claim:

1. A process for casting an iron based material in a mold, comprising the steps of:

forming a molten iron base metal;

placing one or more pieces comprising ceramic particles held together by a binder into position for contact with a stream of the molten iron base metal during pouring of the molten iron base metal into the mold, wherein the ceramic particles have a higher melting temperature than the melting temperature of the molten iron base metal and do not substantially react or dissolve in the molten iron base metal;

pouring the molten iron base metal into the mold so that the molten iron base metal contacts the pieces containing the ceramic and gradually releases the ceramic particles into the stream of the molten iron base metal as it flows into the mold whereby the ceramic particles become distributed in the molten iron base metal; and cooling the molten iron base metal to form a solid composite casting having the ceramic particles distributed in a metal matrix of the iron base metal.

2. The process of claim 1, wherein the placing step comprises disposing pieces containing the ceramic particulate in spaced positions in the mold prior to pouring molten iron base metal therein.

3. The process of claim 1, wherein the placing step comprises disposing a piece containing the particles at the bottom of the mold downsprue, and the pouring step comprises pouring the molten iron base metal into the downsprue, from which the molten iron base metal spreads throughout the mold.

4. The process of claim 1, wherein the ceramic particles have a different density than the molten iron base metal, further comprising delaying cooling of the composite casting for a time sufficient to permit ceramic particles to rise or sink towards an outer surface of the composite casting so that the composite casting has more of the ceramic particles in a surface portion thereof than in an interior portion thereof.

5. The process of claim 1, wherein the ceramic particles have a density less than that of the metal matrix and are selected from the group consisting of ceramic oxides, nitrides, carbides, have sizes in the range of about 5 μm to 100 μm, and comprise 10 to 40 volume percent of the composite casting, and the molten iron base metal consists essentially of iron or steel.

6. The process of claim 1, wherein the binder consists essentially of a metal having a melting temperature the same as or lower than iron and is used in an amount such that the binder metal dissolves substantially completely in the molten iron base metal.

7. The process of claim 5, wherein the binder consists essentially of aluminum.

8. The process of claim 7, wherein the ceramic particles consist essentially of aluminum oxide, and the metal matrix is cast iron.

9. The process of claim 1, wherein the placing step comprises placing a plurality of discrete pieces of ceramic particles held together by a binder into position for contact with a stream of the molten iron base metal during pouring of the molten iron base metal into the mold.

10. The process of claim 1, wherein the ceramic particles have a density less than that of the metal matrix.

11. The process of claim 1, wherein the ceramic particles consist essentially of a ceramic oxide, and the metal matrix is cast iron.

12. A process for casting an iron-based material in a mold, comprising the steps of:

forming a molten iron base metal;

placing a piece comprising ceramic particles held together by a binder in a position outside of the mold but suitable for contact with a stream of the molten iron base metal during pouring of the molten iron base metal into the mold;

pouring the molten iron base metal into the mold so that the molten iron base metal spreads throughout the mold and contacts the piece containing the ceramic, gradually releasing the ceramic particles into the stream of the molten iron base metal as it flows into the mold, whereby the ceramic particles become distributed in the molten iron base metal; and cooling the molten iron base metal to form a solid composite casting having the ceramic particles distributed in a metal matrix of the iron base metal.

13. The process of claim 12, wherein the ceramic particles have a density less than that of the metal matrix and are selected from the group consisting of ceramic oxides, nitrides, carbides, have sizes in the range of about 5 μm to 100 μm, and comprise 10 to 40 volume percent of the composite casting; and the molten iron base metal consists essentially of iron or steel.

14. The process of claim 13, wherein the ceramic particles consist essentially of a ceramic oxide, and the metal matrix is cast iron.

15. The process of claim 12, wherein the placing step comprises disposing the piece containing the particles at the bottom of a mold downsprue, and the pouring step comprises pouring the molten iron base metal into the downsprue, from which the molten iron base metal spreads throughout the mold.

16. A process for casting an iron-based material in a mold, comprising the steps of:

forming a molten iron base metal;

placing one or more pieces comprising ceramic particles having a different density than the molten iron base metal held together by a binder into position for contact with a stream of the molten iron base metal during pouring of the molten iron base metal into the mold;

pouring the molten iron base metal into the mold so that the molten iron base metal contacts the pieces containing the ceramic and gradually releases the ceramic particles into the stream of the molten iron base metal as it flows into the mold, whereby the ceramic particles become distributed in the molten iron base metal;

delaying cooling for a time sufficient to permit ceramic particles to rise or sink to form a composite casting having more of the ceramic particles in a surface portion thereof than in an interior portion thereof;

then cooling the molten iron base metal to form a solid composite casting having the ceramic particles distributed in a metal matrix of the iron base metal.

17. The process of claim 16, wherein the ceramic particles have a density less than that of the metal matrix and are selected from the group consisting of ceramic oxides, nitrides, carbides, have sizes in the range of about 5 μm to 100 μm, and comprise 10 to 40 volume percent of the composite casting; and the molten iron base metal consists essentially of iron and steel.

18. The process of claim 17, wherein the ceramic particles consist essentially of a ceramic oxide, and the metal matrix is cast iron.

* * * * *